US009498808B2

(12) United States Patent
Yamamoto

(10) Patent No.: US 9,498,808 B2
(45) Date of Patent: Nov. 22, 2016

(54) CONTAINER DEGASSING DEVICE FOR EXTRUSION PRESS

(71) Applicant: Ube Machinery Corporation, Ltd., Ube-shi (JP)

(72) Inventor: Takeharu Yamamoto, Ube (JP)

(73) Assignee: Ube Machinery Corporation, Ltd. (JP)

( * ) Notice: Subject to any disclaimer, the term of this patent is extended or adjusted under 35 U.S.C. 154(b) by 0 days.

(21) Appl. No.: 14/758,665

(22) PCT Filed: Jul. 4, 2014

(86) PCT No.: PCT/JP2014/067966
§ 371 (c)(1),
(2) Date: Jun. 30, 2015

(87) PCT Pub. No.: WO2015/012089
PCT Pub. Date: Jan. 29, 2015

(65) Prior Publication Data

US 2015/0352614 A1 Dec. 10, 2015

(30) Foreign Application Priority Data

Jul. 26, 2013 (JP) ..... 2013-155103
Aug. 26, 2013 (JP) ..... 2013-174052

(51) Int. Cl.
*B21C 27/04* (2006.01)
*B21C 23/21* (2006.01)
*B21C 33/00* (2006.01)

(52) U.S. Cl.
CPC ..... *B21C 23/212* (2013.01); *B21C 27/04* (2013.01); *B21C 33/00* (2013.01)

(58) Field of Classification Search
CPC ..... B21C 27/00; B21C 27/04; B21C 29/006; B21C 23/212
USPC ..... 72/272
See application file for complete search history.

(56) References Cited

U.S. PATENT DOCUMENTS 4,862,721 A 9/1989 DeRush
5,392,628 A 2/1995 Cristiani
5,678,442 A * 10/1997 Ohba ..... B21C 23/21 72/272

(Continued)

FOREIGN PATENT DOCUMENTS

| | | |
|---|---|---|
| CN | 1765533 | 5/2006 |
| CN | 101497088 | 8/2009 |
| CN | 101664769 | 3/2010 |
| CN | 102300651 | 12/2011 |
| JP | 48-25315 | 7/1973 |
| JP | 48-25315 B1 | 7/1973 |

(Continued)

OTHER PUBLICATIONS

Chinese Office Action dated May 4, 2016, of corresponding Chinese Application No. 201480006678.9, along with a partial English translation.

*Primary Examiner* — Debra Sullivan
(74) *Attorney, Agent, or Firm* — DLA Piper LLP (US)

(57) ABSTRACT

A container degassing device for an extrusion press is equipped with: a integrally formed degassing block joined to the end surface of the container of the extrusion press; a first sealing member that seals the degassing block; a second sealing member that seals the outer peripheral surface of an extrusion stem or a fixed dummy block of the extrusion press; and a vacuum suction device that sucks air from within a degassing space formed within the container. The degassing space is sealed by the degassing block and the first and second sealing members, and the area between the degassing block and the container end surface is sealed by a metal touch.

7 Claims, 19 Drawing Sheets

(56) References Cited

U.S. PATENT DOCUMENTS

| | | | | |
|---|---|---|---|---|
| 5,896,772 | A * | 4/1999 | Izumi | B21C 26/00 72/272 |
| 7,591,163 | B2 * | 9/2009 | Yamamoto | B21C 23/04 72/272 |
| 2007/0227221 | A1 | 10/2007 | Yamamoto | |
| 2011/0296889 | A1 | 12/2011 | Yamamoto | |

FOREIGN PATENT DOCUMENTS

| | | | |
|---|---|---|---|
| JP | 52-63146 | | 5/1977 |
| JP | 52-63146 | A | 5/1977 |
| JP | 54-30989 | | 10/1979 |
| JP | 5-245533 | A | 9/1993 |
| JP | 10-128432 | A | 5/1998 |
| JP | 2007-260759 | A | 10/2007 |

* cited by examiner

CONTAINER DEGASSING DEVICE FOR EXTRUSION PRESS

TECHNICAL FIELD

The present invention relates to a container degassing device of an extrusion press.

BACKGROUND ART

If loading into a container a billet with a diameter slightly smaller than an inside diameter of the container, then pushing the billet in the container by a rear extrusion stem against a die to cause so-called "upsetting", the billet is crushed and the air between the container and billet is compressed. The method of providing a degassing device for discharging this compressed air from a fixed dummy block side of the extrusion stem to the outside of the container which comprises, for example, to be able to move in an axial direction of the extrusion stem, a ring-shaped seal part which is provided at an extrusion stem-side end face of a container which has a container liner in which a billet is loaded, a seal block which is split in two in a direction crossing an axial direction of the extrusion stem, and a pushing device which, when closing the seal block, can make a side end face of the ring-shaped seal part and an outer circumferential surface of the extrusion stem simultaneously closely contact each other through a seal member which is attached to an abutting surface of the seal block and a seal member which is provided at an extrusion stem-side end face of the seal block and which pushes a seal member which is provided at a container-side end face of the seal block against the ring-shaped seal part and of sealing the inside of the container by a seal material while sucking out and removing the air from the gap between the fixed dummy block outer circumferential surface and the container inner circumference wall surface is disclosed in PLT 1.

CITATIONS LIST

Patent Literature

PLT 1: Japanese Patent Publication No. 10-128432A

SUMMARY OF INVENTION

Technical Problem

In the past, seal members, such as heat resistant rubber (silicone etc.) have been used for sealing a container end face and an extrusion stem outer circumferential surface. Due to the high temperature or the abrasion caused by movement of the extrusion stem etc., the seal material quickly deteriorated, the sealability became poor, and variations arose in the vacuum degree in the container, so the seal material had to be frequently changed. In a conventional extrusion press, a seal block loading device, opening/closing device, etc., are provided. The installation space for the extrusion press apparatus became larger and simultaneously the apparatus became complicated. Maintenance took time.

Solution to Problem

To solve this problem, the present invention provides a container degassing device of an extrusion press comprising a one-piece degassing block which is joined with an end face of a container of the extrusion press, a first seal member which closely contacts the degassing block, a second seal member which closely contacts an outer circumferential surface of a fixed dummy block or extrusion stem of the extrusion press, and a vacuum suction device which sucks out air in a degassing space which is formed in the container, wherein the degassing space is tightly closed by the degassing block and the first and second seal members, and the degassing block and the container end face are tightly closed by metal-to-metal contact.

In the present invention, the degassing block can have at least one hole for removing air which is communicated with the degassing space and fluidly connected to the vacuum suction device, the first seal member can be configured to tightly close the degassing block by metal-to-metal contact, and, when degassing the degassing space, the atmospheric pressure outside the degassing space can act on the first and second seal members so that the tight closure of the degassing space is improved.

In the present invention, the first seal member and the second seal member may contact each other and the second seal member may receive force from the first seal member.

The present invention further provides a container degassing device of an extrusion press comprising a one-piece degassing block which is joined with an end face of a container of the extrusion press, a first seal member which closely contacts the degassing block, at least one second seal member which closely contacts an outer circumferential surface of a fixed dummy block or extrusion stem of the extrusion press, and a vacuum suction device which sucks out air in a degassing space which is formed in the container, wherein the first and second seal members can move relative to the extrusion stem, the degassing space is tightly closed by the degassing block and the first and second seal members, and the degassing block and the container end face are tightly closed by metal-to-metal contact.

In the present invention, the degassing device can further comprise pushing frames which make the first seal member move to push against the degassing block and are operated by fluid cylinders, the first seal member and the second seal member can contact each other, and the second seal member can receive force through the first seal member from the pushing frames.

In the present invention, the pushing frames may move up and down together with the extrusion stem and may be provided with turn stoppers.

In the present invention, a container-side end face of the degassing block may be provided with a cut groove for removing air.

Further, to solve the above problem, there is provided an extrusion pressure which comprises a degassing means of a container which has means for sealing the container end face and the outer circumferential surface of the extrusion stem, wherein a one-piece degassing block is made to abut against the container end face by metal-to-metal contact and wherein a vacuum pump etc. is used to remove the air from the inside of the container.

A through hole for removing air is drilled through the degassing block, a space which is surrounded by the degassing block seal member which is made to abut by the metal-to-metal contact is degassed by a vacuum pump, etc., and the force of atmospheric pressure is utilized to give sealability and evacuate the space to vacuum.

The space which is surrounded by the degassing block and the seal member which abuts against a fixed dummy block or extrusion stem is degassed by vacuum.

Still further, to solve the above problem, the present invention provides an extrusion press comprising a degassing means of a container which has a means for tightly closing a container end face and an outer circumferential surface of an extrusion stem, which makes a one-piece degassing block abut against a container end face by metal-to-metal contact and removes air from a degassing space which is surrounded by the degassing block and a movable seal member which abuts against a fixed dummy block or extrusion stem using a vacuum pump etc.

The movable seal member is moved by pushing frames which can move by fluid cylinders and are pushed against the degassing block for the seal.

Advantageous Effects of Invention

The one-piece degassing block is made to abut against the container end face and tightly closes it by metal-to-metal contact, so the seal member made of the elastic material which is required for that part in the conventional device becomes unnecessary. Further, if making the first seal member for example one made of a nonferrous metal material and tightly closing the degassing block by metal-to-metal contact, it becomes possible to greatly reduce the frequency of replacement of the seal member.

In the past, a two-piece split degassing block has been loaded by a loading device or joined by an opening/closing device, but in the present invention, the loading device and opening/closing device of the degassing block are no longer necessary, space saving can be realized, and the apparatus can be simplified thereby facilitating maintenance, etc.

DESCRIPTION OF EMBODIMENTS

Figure 1:
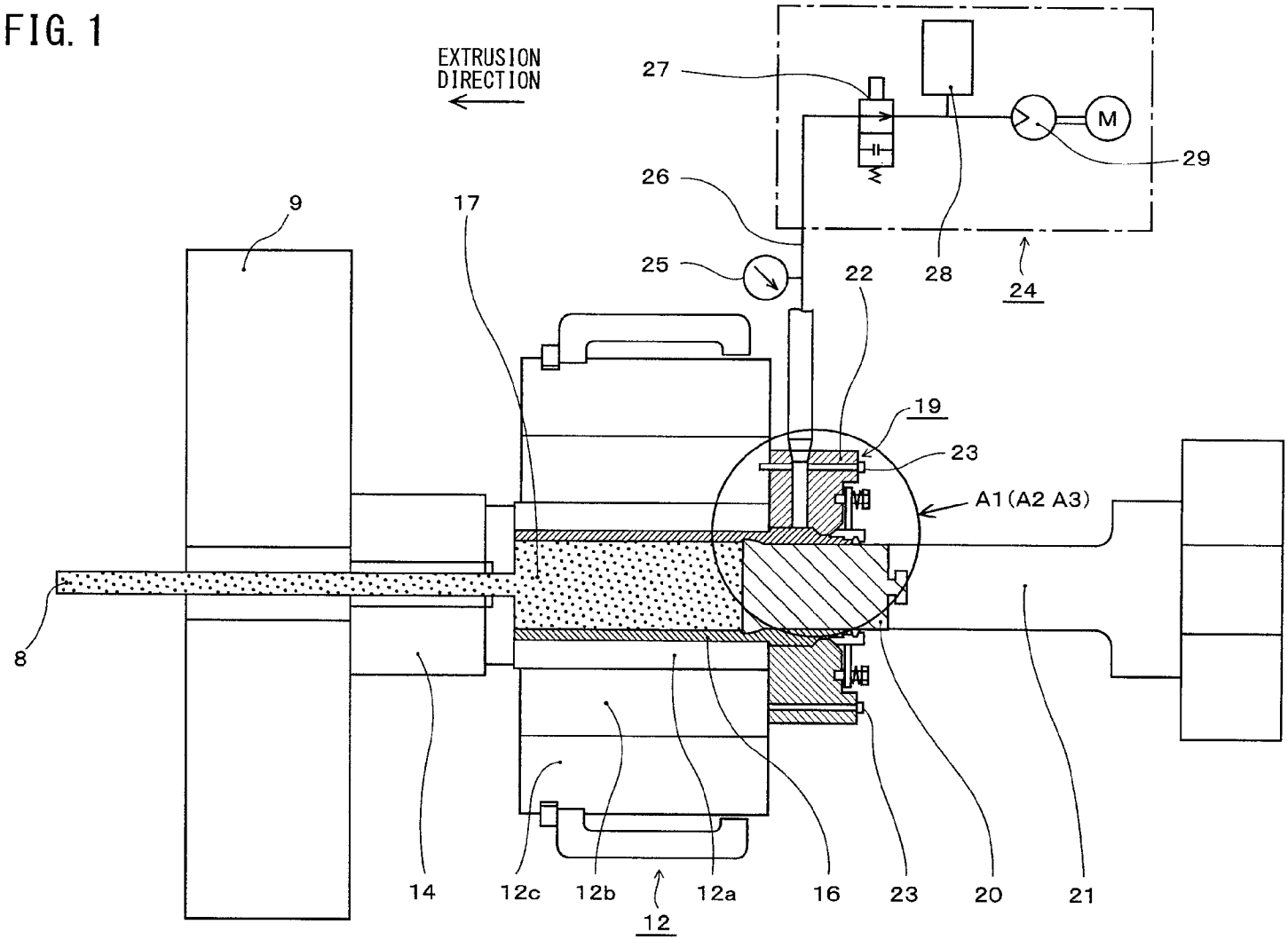
FIG. 1 is a cross-sectional view of a side view which shows an outline of a part from an end platen to an extrusion stem of an extrusion press according to a first embodiment of the present invention.

In an extrusion pressure according to a first embodiment of the present invention, as shown in FIG. 1, there is a die 14 sandwiched between an end platen 9 and a container 12 which comprises a container liner 12*a*, container tire 12*b*, and container holder 12*c*. The die 14 is held by fitting its outer circumference slidably into an inner circumferential surface of a not shown die ring.

Degassing space 16 is the clearance between the inner circumference wall surface of the container liner 12*a* and the outer circumferential surface of the billet 17. On the other hand, at a front end of an extrusion stem 21 which pushes in a billet 17, a fixed dummy block 20 which can closely contact the inner circumference wall surface of the container liner 12*a* by extension and retraction of the outer circumference front end part is provided.

Reference numeral 8 is an extruded material obtained by crushing of the billet 17 and extrusion from the die 14 along with advance of the extrusion stem 21.

A degassing means 19 for tightly closing the degassing space 16 and sucking out the air at the inside in the present embodiment will be explained.

First, the degassing means 19 for sucking out the air from the extrusion stem 21 side in the container 12 is provided with a degassing block 22 which is arranged at the extrusion stem 21 side end face of the container 12 and is joined in a direction crossing the axial direction of the extrusion stem 21. It is configured to make the degassing block 22 closely contact the outer circumferential surface of the fixed dummy block 20 or extrusion stem 21 and make the degassing block 22 closely contact the container end face and fasten it by bolts 23 to tightly seal the container 12.

The degassing means 19 has a vacuum suction device 24. The vacuum suction device 24 is provided with a pressure sensor 25, piping 26, solenoid valve 27, vacuum tank 28, vacuum pump 29, etc., and is designed to be communicated with the degassing space 16 through the degassing means 19 and the piping 26 when sucking out the air at the inside of the container 12.

The degassing means 19 also has means, i.e., seal members, for realizing air-tightness between the degassing block 22 and fixed dummy block 20 or extrusion stem 21. These are shown in FIG. 2A and FIG. 2B.

Figure 2A:
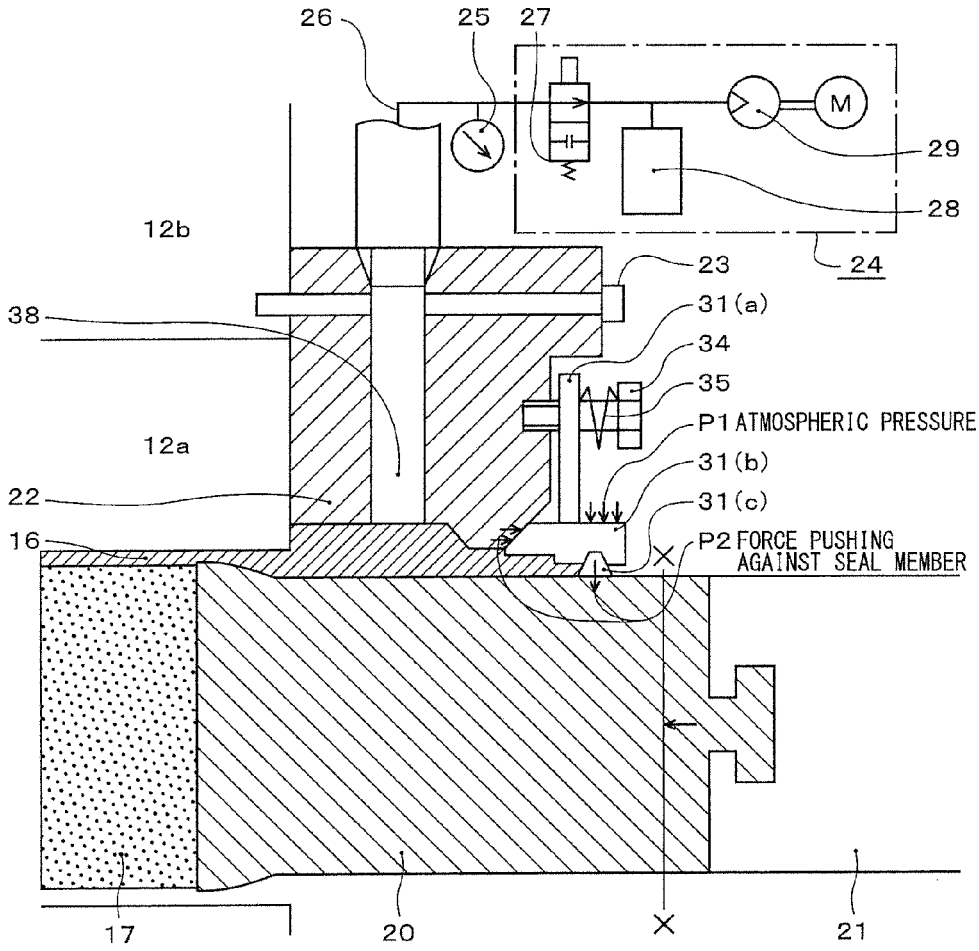
FIG. 2A is an enlarged view of a part A1 of FIG. 1.
Figure 2B:
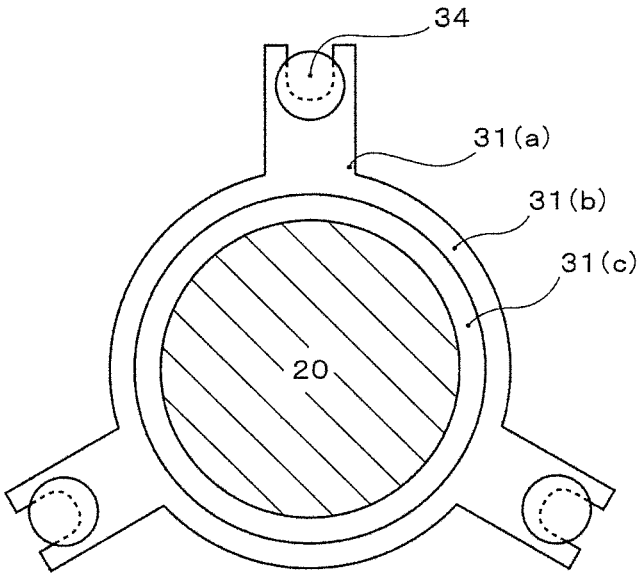
FIG. 2B is a cross-sectional view along X-X of FIG. 2A seen toward an extrusion direction.

In FIG. 2A and FIG. 2B, a combination of nonferrous metal ring-shaped seal members 31(*a*), 31(*b*) fixed by a plurality of bolts 34 with springs 35 to the degassing block 22 and a seal member 31(*c*) made of a heat resistant elastic material or nonferrous metal material is used to tightly close the degassing space 16.

Figure 3:
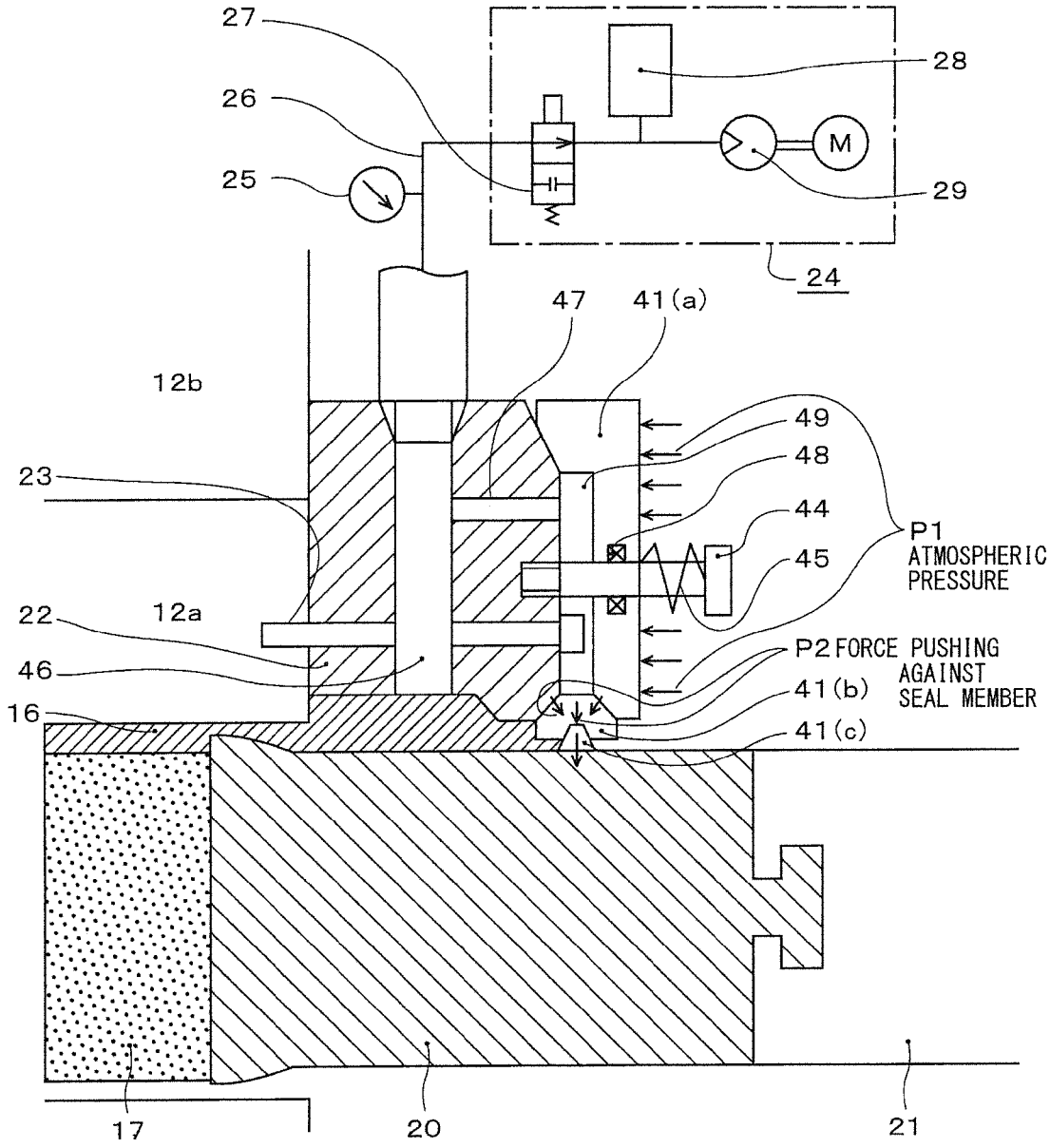
FIG. 3 is an enlarged view of a part A2 of FIG. 1, similar to FIG. 2A, of an extrusion press according to a second embodiment of the present invention.

In FIG. 3 which shows a second embodiment, a combination of an L-cross-section ring-shaped seal member 41(*a*) fixed by a plurality of bolts 44 with springs 45 to the degassing block 22, a ring shaped substantially frustoconical cross-section seal member 41(*b*) of for example a nonferrous metal material, and a seal member 41(*c*) made of a heat resistant elastic material are used to tightly close the degassing space 16.

Figure 4:
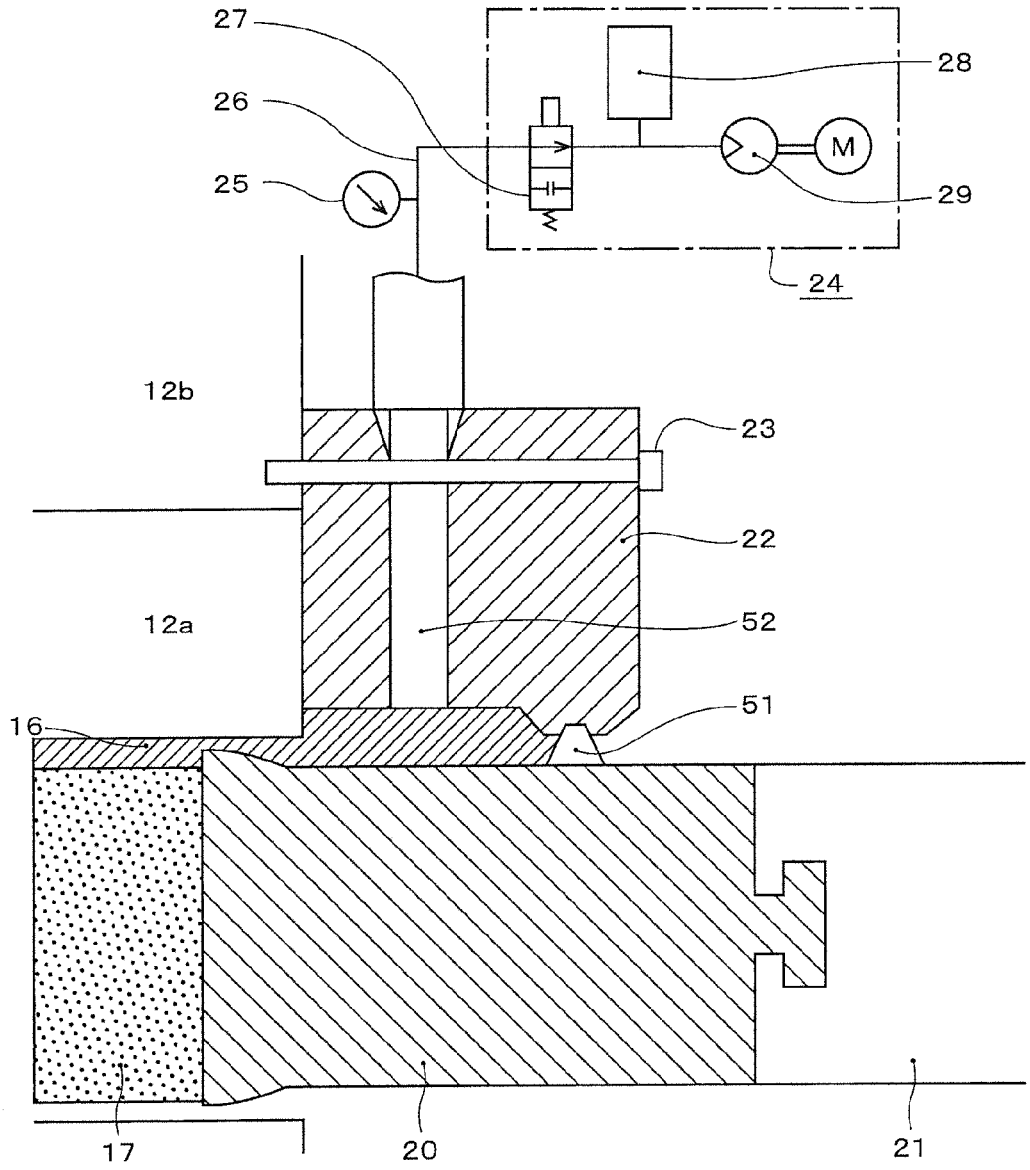
FIG. 4 is an enlarged view of a part A3 of FIG. 1, similar to FIG. 2A, of an extrusion press according to a third embodiment of the present invention. Note that, the part A1, the part A2, and the part A3 show different embodiments of the same location.

In FIG. 4 which shows a third embodiment, the degassing block 22 and the fixed dummy block 20 or extrusion stem 21 are configured to tightly close the degassing space 16 which is sealed by a seal member 51 made of a heat resistant elastic material or nonferrous metal material.

Figure 5:
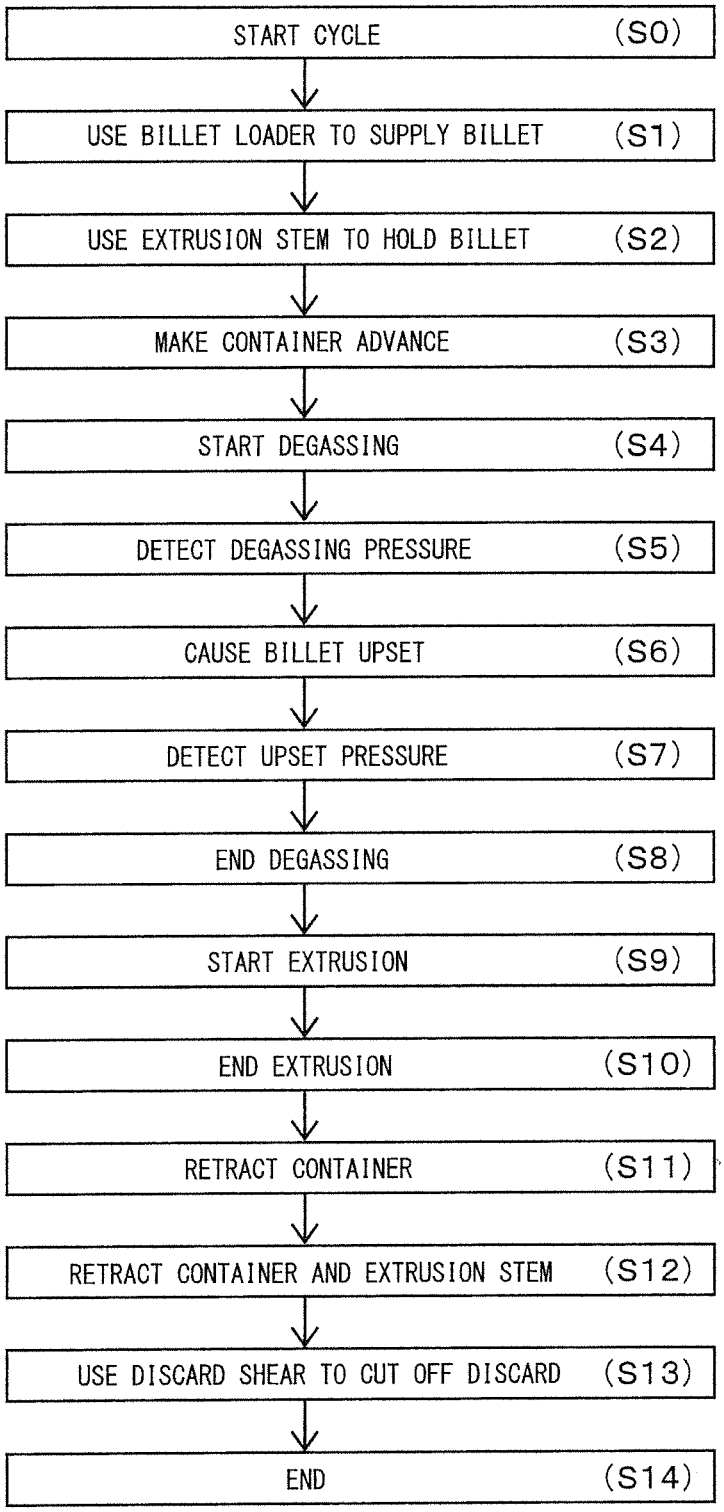
FIG. 5 is an operational flow chart of an extrusion press according to the first to third embodiments of the present invention.

Next, the extrusion operations of extrusion presses according to the first to third embodiments will be explained based on the operational flow chart of FIG. 5.

In the initial state, the container 12 and the extrusion stem 21 retract in the anti-extrusion direction.

First, to start, a not shown billet loader supplies a billet 17 between the die 14 and the fixed dummy block 20 over the axial line of the extrusion stem 21 (S1). Next, the extrusion stem 21 advances whereby the billet 17 is held between the die 14 and the fixed dummy block 20 (S2). Next, the billet loader moves to the outside of the extrusion press, and then pressurized oil is fed to a not shown container cylinder, whereby the container 12 advances (S3).

In this state, the air in the degassing space 16 in the container 12 starts to be removed (S4). When the vacuum value of the degassing space 16 reaches the target value (detected by the pressure sensor 25 (S5)), the upsetting operation of the billet 17 is started (S6). When the pressure of the upsetting reaches the target value (S7), the degassing space 16 finishes being degassed (S8) and simultaneously the extrusion is started (S9).

The timing of startup of the vacuum suction device 24, that is, the start of degassing, may be any of a timing before the start of the upsetting operation after loading the billet 17 in the container 12, simultaneous with the start, or after the elapse of a certain time after the start of the upsetting operation. A suitable start timing for the various conditions of the extrusion is selected. The degassing is ended after it is detected that the degassing space 16 has reached a predetermined vacuum degree.

After detecting that the upsetting operation of the billet 17 has been completed, extrusion is started along with advance of the extrusion stem 21 and the extruded material 8 is extruded from the die 14.

After the extrusion ends (S10), the container 12 retracts just slightly and the not shown discard is separated from the container (S11). Next, the container 12 and the extrusion stem 21 simultaneously retract to the point of time of start (S12). Therefore, a not shown discard shear descends and cuts off the discard (S13).

Due to the above, one cycle of extrusion is ended (S14) and the next cycle is proceeded to.

The degassing block 22 which is shown in FIG. 1 will be explained. The degassing block 22 is fabricated as a one-piece donut shape by a ferrous material. It is formed with one or more through holes for sucking out the air in the degassing space 16 by a vacuum suction device 24.

Formation of a plurality of through holes gives a larger pipeline cross-sectional area and enables the degassing space 16 to reach a vacuum state faster. Due to this, it becomes possible to make the degassing block 22 thinner. As a result, it is possible to shorten the length of the extrusion stem 21.

The degassing block 22 is fixed to the container 12 by bolts 23 or other fastening parts.

The degassing block 22 and the container 12 are sealed by metal-to-metal contact, so the contact surface of the degassing block is finished to a fine surface roughness of an extent enabling a seal. Alternatively, it may be possible to provide a projecting part at the metal-to-metal contact surface of the degassing block 22, provide a recessed part at the contact surface of the container 12, provide this projecting part and recessed part at one location or several locations as the metal-to-metal contact surface, and thereby give sealability to the metal-to-metal contact.

The enlarged view of the part A1 of the first embodiment which is shown in FIG. 2A will be explained. The seal member 31(*a*) and the seal member 31(*b*) are fabricated by nonferrous metal and are made ring shaped. The seal member 31(*a*) and the seal member 31(*b*) are welded together etc. to form an integral structure. The seal member 31(*a*) forms a clearance with the degassing block 22 at the vertical surface, while the seal member 31(*b*) forms metal-to-metal contact with the degassing block 22 at its tapered surface. The respective metal-to-metal contact surfaces are finished to a fine enough surface roughness enabling a seal. The seal member 31(*a*) is fixed to the degassing block 22 at several locations by bolts 34 or other fastening parts with springs 35. The seal member 31(*c*) is made of a heat resistant elastic material or nonferrous metal. When the seal member 31(*c*) is a nonferrous metal, it may be made an integral part with the seal member 31(*b*). The seal member 31(*c*) may be a material which has heat resistance, for example, silicone rubber or fluororubber, processed into a sponge-like sheet shape.

The degassing block is formed with one or more through holes 38, in the latter case for minimizing the thickness dimension of the degassing block, for sucking out the air to create a vacuum by the vacuum suction device 24. Therefore, if using the vacuum suction device 24 to suck out the air to create a vacuum, the degassing space 16 becomes a vacuum state, the seal member 31(*b*) is acted on by atmospheric pressure such as shown by the arrow mark, and the sealability of the tapered surface of the seal member 31(*b*) and that of the seal member 31(*c*) is improved. Note that, for that purpose, the seal member 31(*b*) has to be made thin.

The enlarged view of the part A2 of the second embodiment which is shown in FIG. 3 will be explained. The seal member 41(*a*) which has an L-cross-section and is fabricated by a ring-shaped nonferrous metal may be joined with the degassing block 22 at the tapered surface by metal-to-metal contact. The seal member 41(*a*) is fixed to the degassing block 22 by a fastening part, such as a bolt 44 with a spring 45 which is sealed by a nonmetal elastic material 48.

The substantially frustoconical cross-section, ring shaped seal member 41(*b*) joins the degassing block 22 and the seal member 41(*a*) at their tapered surfaces by metal-to-metal contact. This may also be combined with the heat resistant elastic material or nonferrous metal seal member 41(*c*) to exhibit close adhesion and hold the vacuum of the degassing space 16. When the seal member 41(*c*) is a nonferrous metal, it may also be formed integrally with the seal member 41(*b*). The seal member 41(*c*) may also be a material which has heat resistance, for example, silicone rubber or fluororubber, which is processed into a sponge-like sheet shape.

The degassing block 22 is provided with one or more through holes 46 for sucking out air by the vacuum suction device 24. One or more degassing passages 47 are formed from these through holes to the chamber 49. Therefore, if sucking out the air to create a vacuum by the vacuum suction device 24, the chamber 49 also becomes a vacuum state, the seal member 41(*b*) is acted on by atmospheric pressure such as shown by the arrow mark, and the sealability is improved.

Therefore, for the seal of the outer circumferential surface of the extrusion stem 21, due to the wedge effect of the seal member 41(*b*), an action of pushing the seal member 41(*c*) from the outer circumference is obtained and an improvement in the sealability can be realized.

Note that, for that purpose, the seal members 41(*a*) and 41(*b*) have to be made thin.

The enlarged view of the part A3 of the third embodiment which is shown in FIG. 4 will be explained. The degassing block and the fixed dummy block 20 or extrusion stem 21 are sealed by the seal member 51.

The seal member 51 is preferably made of a material which has heat resistance, for example, a nonferrous metal. Alternatively, it may be made of silicone rubber or fluororubber processed into a sponge-like sheet shape.

The air of the degassing space 16 passes through the through holes 52 and is sucked out by the vacuum suction device 24 to create a vacuum.

The one-piece degassing block is made to abut against the container end face, a vacuum pump etc. is used to remove the air in the container, the degassing block is formed with through holes for degassing use, and the space surrounded by the degassing block and the seal member abutting against it by metal-to-metal contact is given sealability utilizing the force of atmospheric pressure and degassed to create a vacuum, so a high vacuum with no variation can be maintained for a long period of time in the container.

As a result, air is no longer entrained in the extruded product, blisters and oxides are no longer formed, the yield is improved, and simultaneously there is no longer a burp cycle, the idle time becomes shorter, and the productivity is improved.

Further, the one-piece degassing block is made to abut against the container end face, and the seal member is also made to contact it by metal-to-metal contact, so frequent replacement of the seal member becomes unnecessary and the time for replacement of the seal member can be shortened. In the past, a two-piece split degassing block has been conveyed by a conveyor device or joined by an opening/closing device, but in the present invention, the conveyor device or opening/closing device of the degassing block becomes unnecessary, space saving can be realized, cost can be reduced, and maintenance etc. become easy due to simplification of the structure.

Below, a fourth embodiment to a seventh embodiment will be explained. The fourth embodiment and the fifth embodiment relate to a front loading extrusion press, while the sixth embodiment and the seventh embodiment relate to a rear loading extrusion press.

Figure 6:
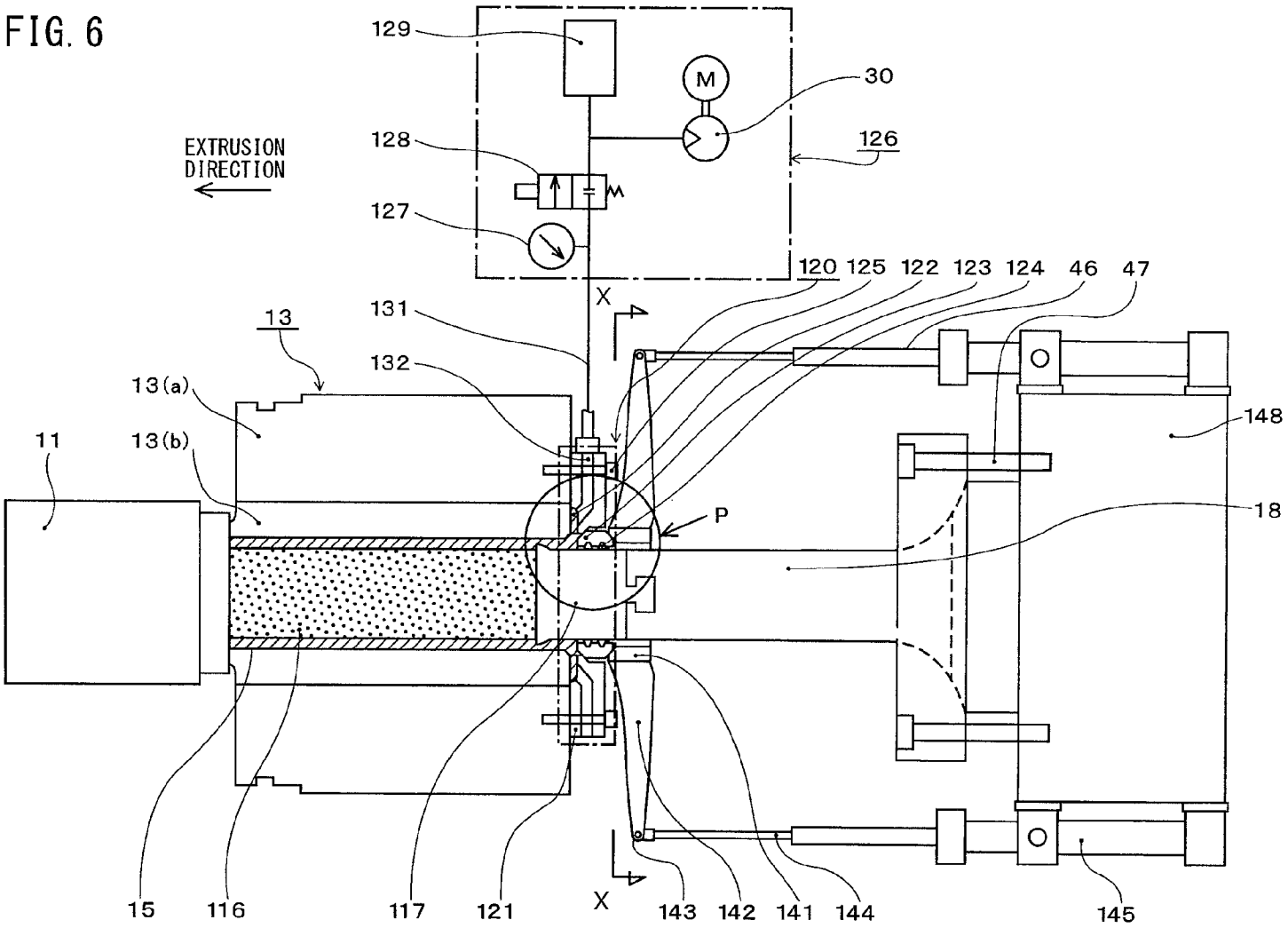
FIG. 6 is a cross-sectional view of a side view which shows an outline of a part from a die to a main crosshead of a front loading extrusion press of a fourth embodiment of the present invention and a view of the state of the inside of the container being degassed.

FIG. 6 is a cross-sectional view of a side view which shows the part from the die to the main crosshead of an extrusion press according to the fourth embodiment.

Reference numeral 11 indicates a die. The die 11 is slidably held by being fit at its the outer circumference at the inner circumferential surface of a not shown die ring. The degassing space 15 is the clearance between the inner circumference wall surface of the container liner 13*b* and the outer circumferential surface of the billet 16. On the other hand, at the front end of the extrusion stem 18 which pushes in the billet 16, a fixed dummy block 117 which can tightly contact the inner circumference wall surface of the container liner 13*b* by expansion and contraction of the outer circumference front end part is provided.

A not shown extruded material is extruded from the die 11 by crushing of the billet 116 along with advance of the extrusion stem 18.

A degassing means 120 for tightly closing the degassing space 15 and sucking out the air inside it in the fourth embodiment will be explained next.

First, the degassing means 120 for sucking out the air from the extrusion stem 18 side of the container 13 is provided with a degassing block 121 which is arranged at the extrusion stem 18 side end face of the container 13 and which is joined in the direction crossing the axial direction of the extrusion stem 18. The degassing means 120 is also provided with a seal member 123 which is pushed against the degassing block 121 and a seal member 124 which abuts against the outer circumferential surface of the fixed dummy block 117 or extrusion stem 18, and makes the degassing block 121 closely contact the container end face and fastens it by bolts 125 to tightly seal the container 13.

The degassing means 120 also has a vacuum suction device 126. The vacuum suction device 126 is provided with a pressure sensor 127, piping 131, solenoid valve 128, vacuum tank 129, vacuum pump 30, etc. and is configured to communicate with the degassing space 15 through the degassing means 120 and the piping 131 when sucking out the air inside of the container 13.

The degassing block 121 which is shown in FIG. 6 will be further explained. The degassing block 121 is fabricated as a one-piece donut shape by a ferrous material. It is formed with one or more degassing passages 132 for sucking out the air in the degassing space 15 by a vacuum suction device 126.

Formation of a plurality of degassing passages 132 gives a larger pipeline cross-sectional area and enables the degassing space 15 to reach a vacuum state faster. Due to this, it becomes possible to make the degassing block 121 thinner. As a result, it is possible to shorten the length of the extrusion stem 18.

The degassing block 121 is fixed to the container 13 by bolts 125 or other fastening parts.

The degassing block 121 and the container 13 are sealed by metal-to-metal contact, so the contact surface of the degassing block 121 is finished to a fine surface roughness of an extent enabling a seal. Alternatively, it may be possible to provide a projecting part at the metal-to-metal contact surface of the degassing block 121, provide a recessed part at the contact surface of the container 13, provide this projecting part and recessed part at one location or several locations as the metal-to-metal contact surface, and thereby give metal-to-metal contact sealability.

Figure 7:
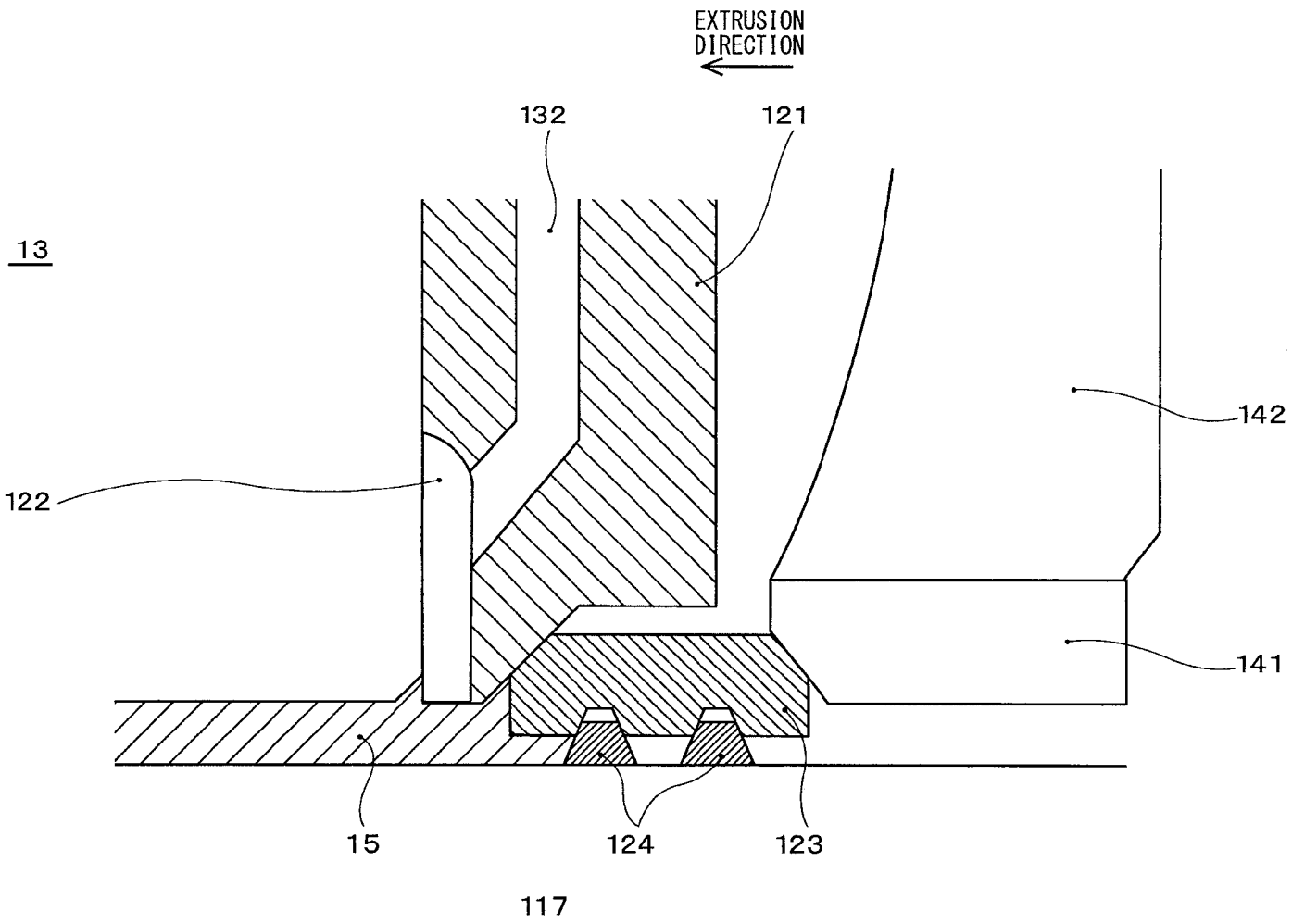
FIG. 7 is a detailed view of a part P of FIG. 6 where the seal member abuts against the degassing block and further the seal member is pushed by a pushing member in the pushing direction.

The seal members 123 and 124 in the fourth embodiment of the present invention are shown in FIG. 7. The seal member 123 is ring shaped in form with a substantially frustoconical cross-section. This seal member 123 is made by a nonferrous metal.

The surface abutting against the fixed dummy block 117 or extrusion stem 18 is sealed by the heat resistant seal member 124 at one or more locations. The seal member 124 preferably uses an elastic material which has heat resistance or a nonferrous metal material.

The seal member 123 has a tapered surface at the surface abutting against the degassing block 121 and seals it by metal-to-metal contact, so the seal member 123 is finished to a fine enough surface roughness so that the surface abutting with the degassing block 121 can be sealed.

Note that, the tapered surface of the other end of the seal member 123 is pushed against by the pushing member 141, whereby the sealability with the degassing block 121 can be improved and the seal member 123 can be made to move in the extrusion direction. In the figure, reference numeral 122 is a cut groove which is formed at the container side end face of the degassing block 121 and enlarges the cross-sectional area of the passage from the degassing space to the degassing passage. As a result, the degree of vacuum of the degassing space is quickly raised.

Figure 8:
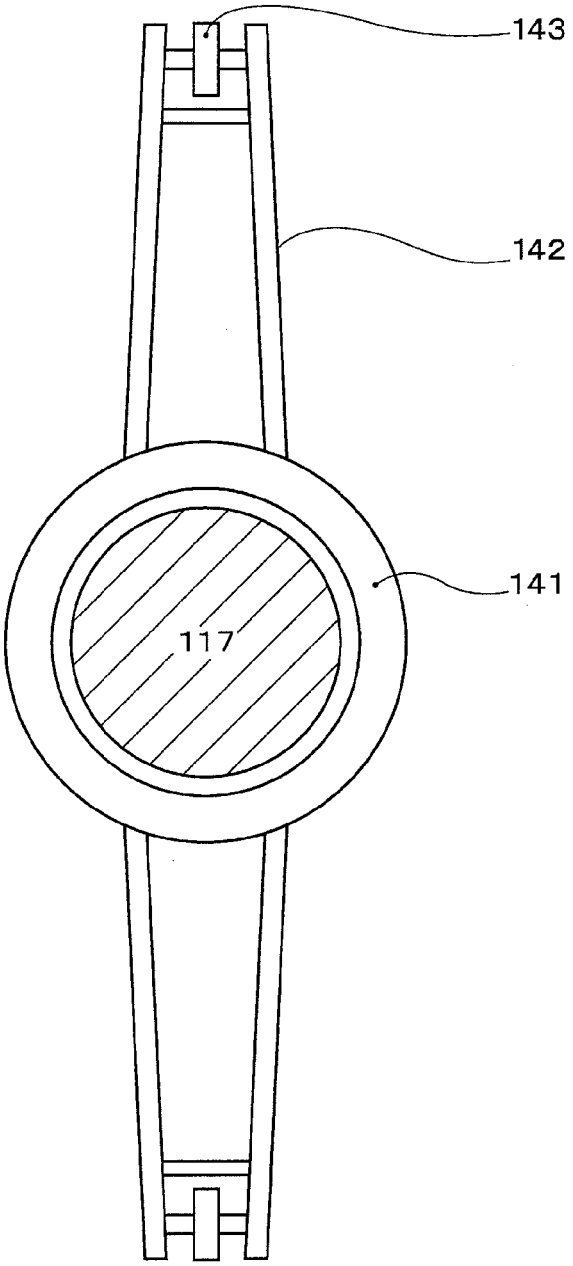
FIG. 8 is a view of the cross-section along X-X of FIG. 6 as seen from the arrow direction and shows details of the pushing member and pushing frames.

The degassing means 120 is further provided with a pushing frame device which is shown in FIG. 6, FIG. 7, and FIG. 8. This pushing frame device will be explained next. FIG. 8 is a cross-sectional view of a pushing frame device as seen along the arrow X-X of FIG. 6. Clevices 143 are fixed to the front ends of rods 144 of hydraulic cylinders 145 which are fastened to a main crosshead 148. From the clevices 143, pushing frames 142 and a pushing member 141 are connected.

As shown in FIG. 8, the pushing frames 142 are provided in sets of two. Two or more sets are combined for assembly.

As shown in FIG. 7, the pushing member 141 pushes against the seal member 123 in the extrusion direction in the state which is shown in the illustration so as to improve the sealability.

In the figure, one set each of the pushing frames 142 is provided above and below the axial center of the extrusion press, but it is also possible to provide one set each at the left and right of the axial center of the extrusion press.

Figure 9:
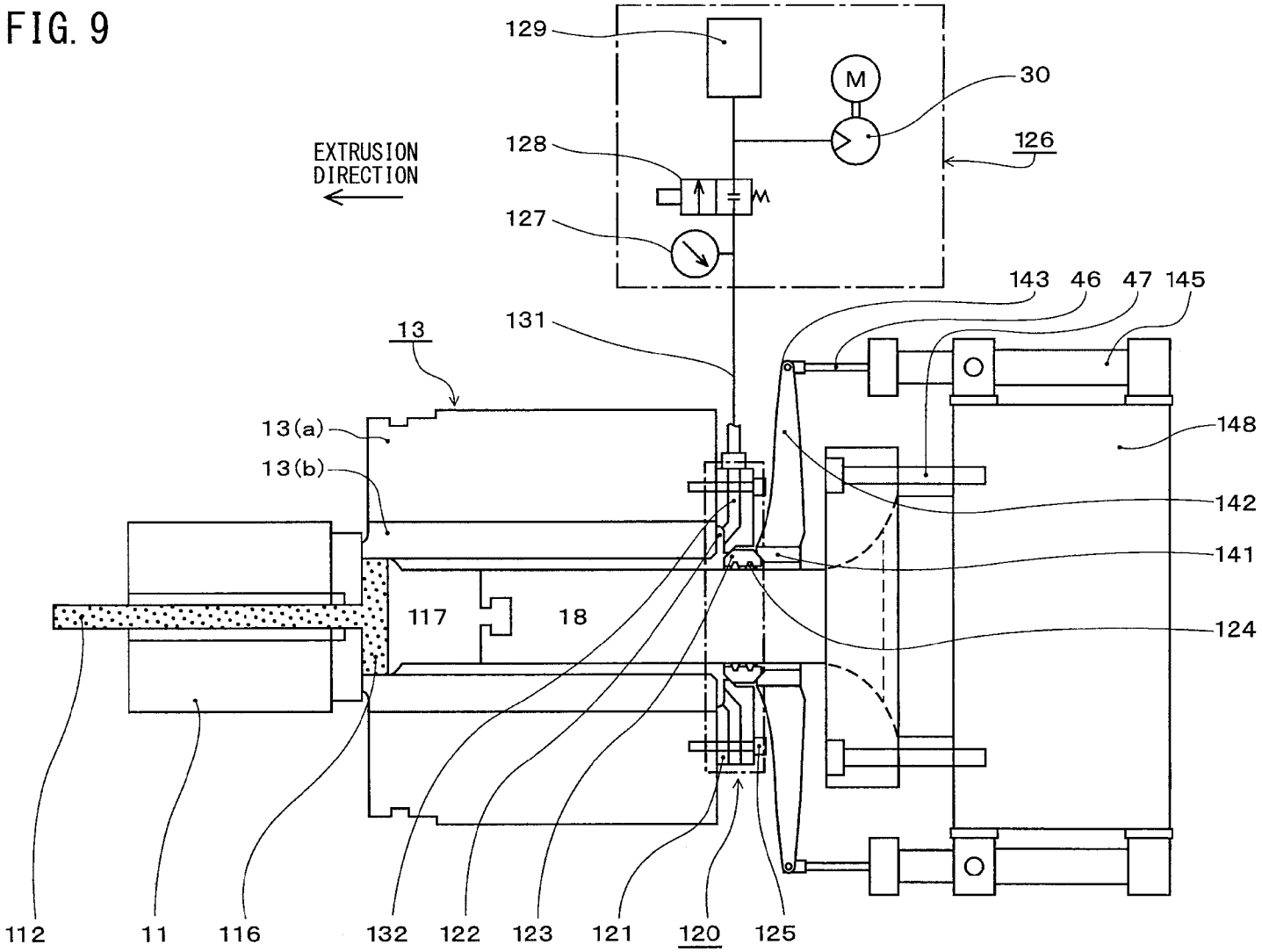
FIG. 9 is a cross-sectional view of a side view of an extrusion press the same as FIG. 6 and a cross-sectional view when the pushing action is completed.

FIG. 9 shows the state of the seal member 123 and the pushing frame device when the extrusion operation is completed.

After starting extrusion, the hydraulic cylinders 145 are set in a free state without sending pressurized oil. At this time, the seal member 123 is in a state abutting against the degassing block 121, so does not move in absolute position, but the extrusion stem 18 advances in the extrusion direction, so the relative position of the seal member 123 with the extrusion stem 18 changes from the initial position of the fixed dummy block 117 gradually in the direction of the position of the extrusion stem 18 and reaches the position of the extrusion stem 18 when the extrusion ends. After that, when the extrusion stem 18 retracts, the seal member 123 retracts while maintaining its position.

That is, the seal member 123 moves back and forth on the fixed dummy block 117 and the extrusion stem 18 at the above position.

Figure 10:
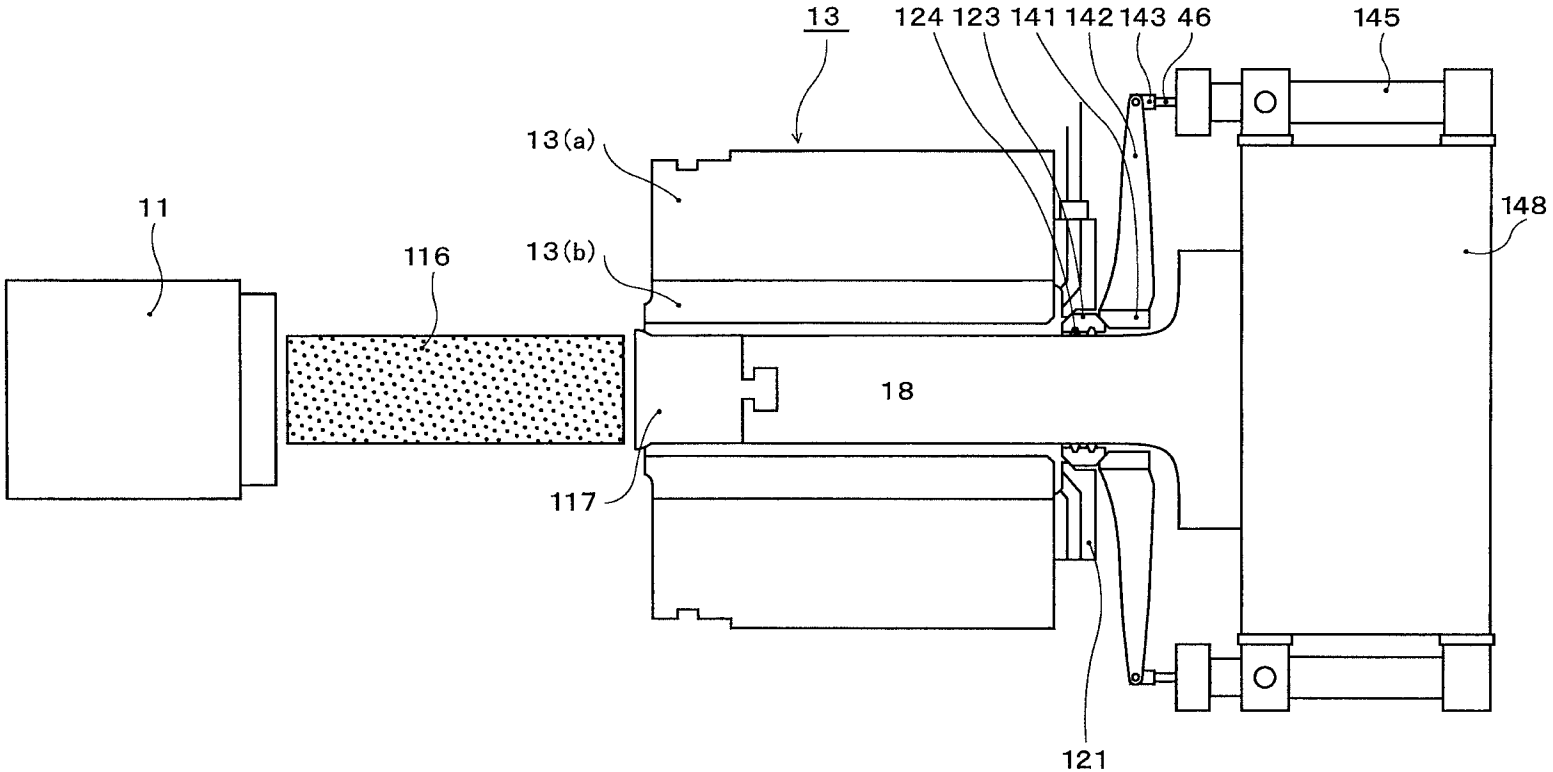
FIG. 10 is a cross-sectional view of a side view of an extrusion press the same as FIG. 6 and a view right before supplying a billet to a container.

FIG. 10 is a schematic view at the time of loading a billet 116 in a front loading extrusion press. In the figure, a not shown billet loader is used to load a billet 116 between the die 11 and the fixed dummy block 117. At this time, the pushing frames 142 stand by at the retraction limit at the anti-extrusion side. Next, the extrusion stem 18 advances and the billet 116 is clamped between the die 11 and the fixed dummy block 117. Next, the billet loader retracts to outside the machine and a not shown container cylinder is used to make the container 13 move in the extrusion direction and abut against the die 11. After that, the pushing frames 142 advance while pushing the seal member 123 in the extrusion direction and make the seal member 123 abut against the degassing block 121.

Figure 11:
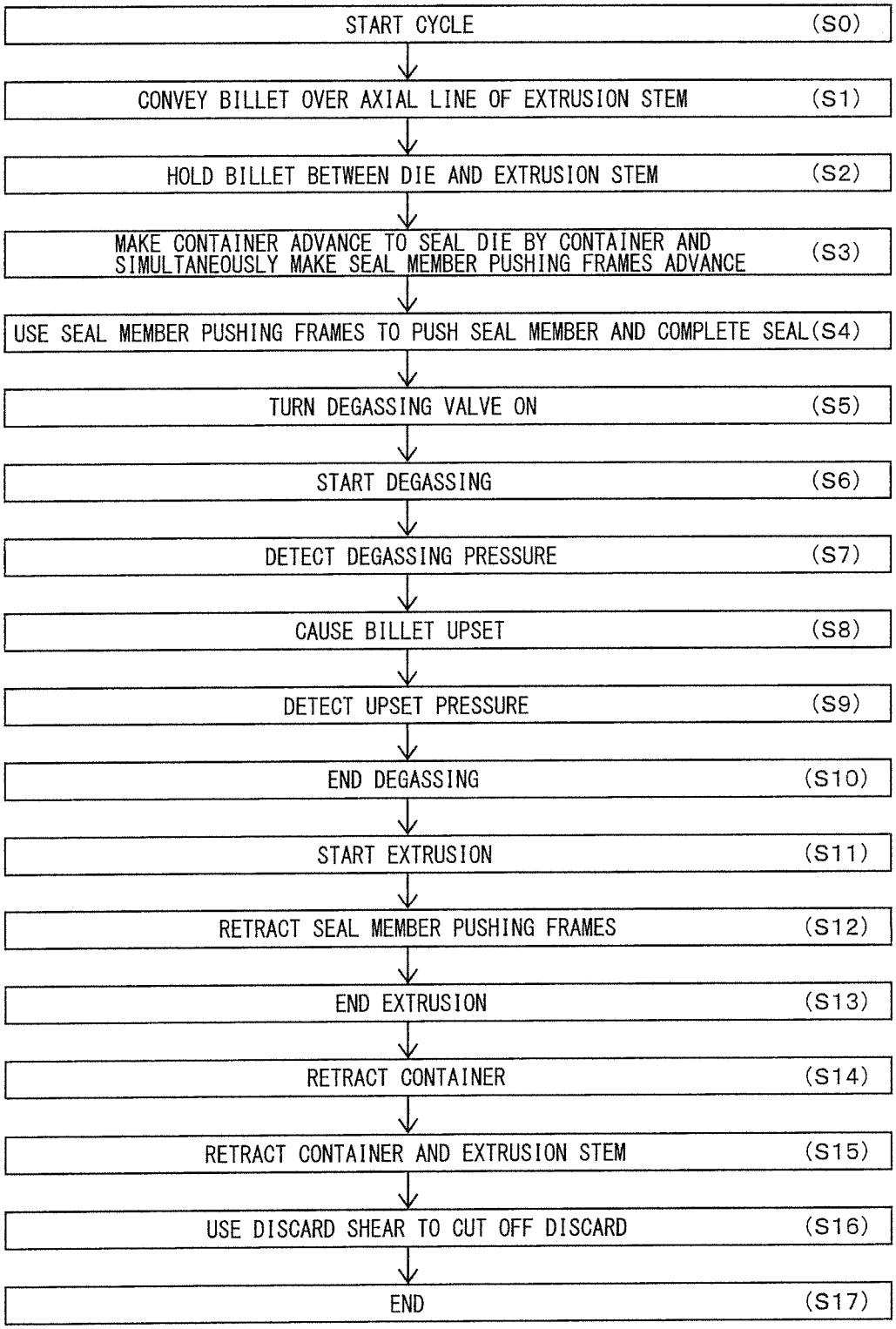
FIG. 11 is an operational flow chart of a front loading extrusion press according to a fourth embodiment.

Next, the extrusion operation of a front loading extrusion press according to the fourth embodiment will be explained based on the operational flow chart of FIG. 11.

At the initial state, the container 13 and the extrusion stem 18 retract in the anti-extrusion direction.

First, to start, a not shown billet loader supplies a billet 116 between the die 11 and the fixed dummy block 117 over the axial line of the extrusion stem 18 (S1). Next, the extrusion stem 18 advances and the billet 116 is held between the die 11 and the fixed dummy block 117 (S2). Next, the container 13 is advanced to seal the die 11 by the container 13 and simultaneously the seal member pushing frames 142 are made to advance (S3). Next, the seal member pushing frames 142 are used to push the seal member 123 against the degassing block 121 to complete the seal (S4).

In this state, air starts to be removed from the degassing space 15 inside of the container 13. First, the degassing valve 128 is turned on (S5), then the air starts to be removed from the degassing space 15 (S6). After the vacuum value of the degassing space 15 reaches the target value (detected at pressure sensor 25 (S7)), the upsetting operation of the billet 116 is started (S8). When the upsetting pressure reaches the target value (S9), the air finishes being removed from the degassing space 15 (S10) and simultaneously extrusion is started (S11).

After the extrusion starts, the pushing frames retract (S12). After the extrusion operation ends (S13), the container 13 is made to retract just slightly (S14). After that, the container 13 and the extrusion stem 18 retract (S15). Next, a not shown discard shear is used to cut off the discard (S16). With the above, the cycle ends (S17) and the next cycle is proceeded to.

Below, the fifth embodiment will be explained. Configurations the same as the fourth embodiment are assigned the same reference numerals. Different structures are assigned reference numerals in the 100s or 200s.

Figure 12:
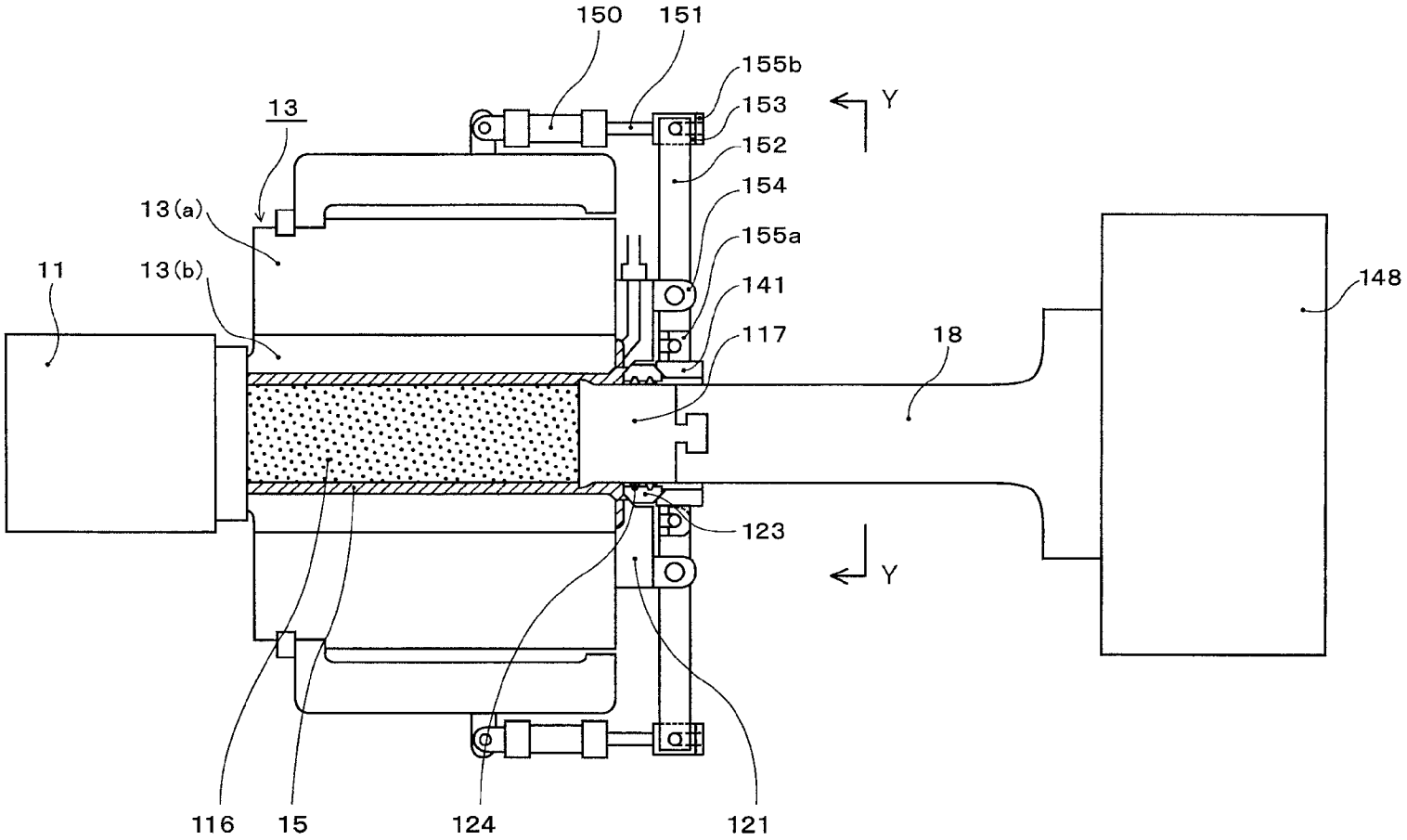
FIG. 12 is a cross-sectional view of a side view of principal parts of a front loading extrusion press according to a fifth embodiment and a view of the state of the inside of the container being degassed.

FIG. 12 shows a front loading extrusion press in which pushing cylinders 150 are fastened to the container 13 according to the fifth embodiment. In the case of a front loading extrusion press, if the pushing cylinders 145 are fastened to the main crosshead 148, it is necessary to lengthen the stroke of the hydraulic cylinder 145, while with a system where the pushing cylinders 150 are fixed to the container 13, the stroke of the pushing cylinders 150 can be made short. This apparatus is designed so that the hydraulic cylinders 150 push by a short stroke against an extrusion lever 152 which is supported by a shaft so as to abut against the seal member 123.

In the present configuration, when replacing the container 13, the fixed dummy block 117 and the extrusion stem 18 have to be detached. For that purpose, the two ends of the extrusion lever 152 have to be made free, so the pushing member 141 side of the extrusion lever 152 and the front end part 153 of the hydraulic cylinder 150 are fastened by key plates 155*a*, 155*b*. When replacing the container 13, the key plate 155*a* and pushing members 141 and the key plates 155*b* and front end parts 153 of the hydraulic cylinders 150 are designed to be able to be detached at any time to enable the container 13 to be replaced.

Figure 13:
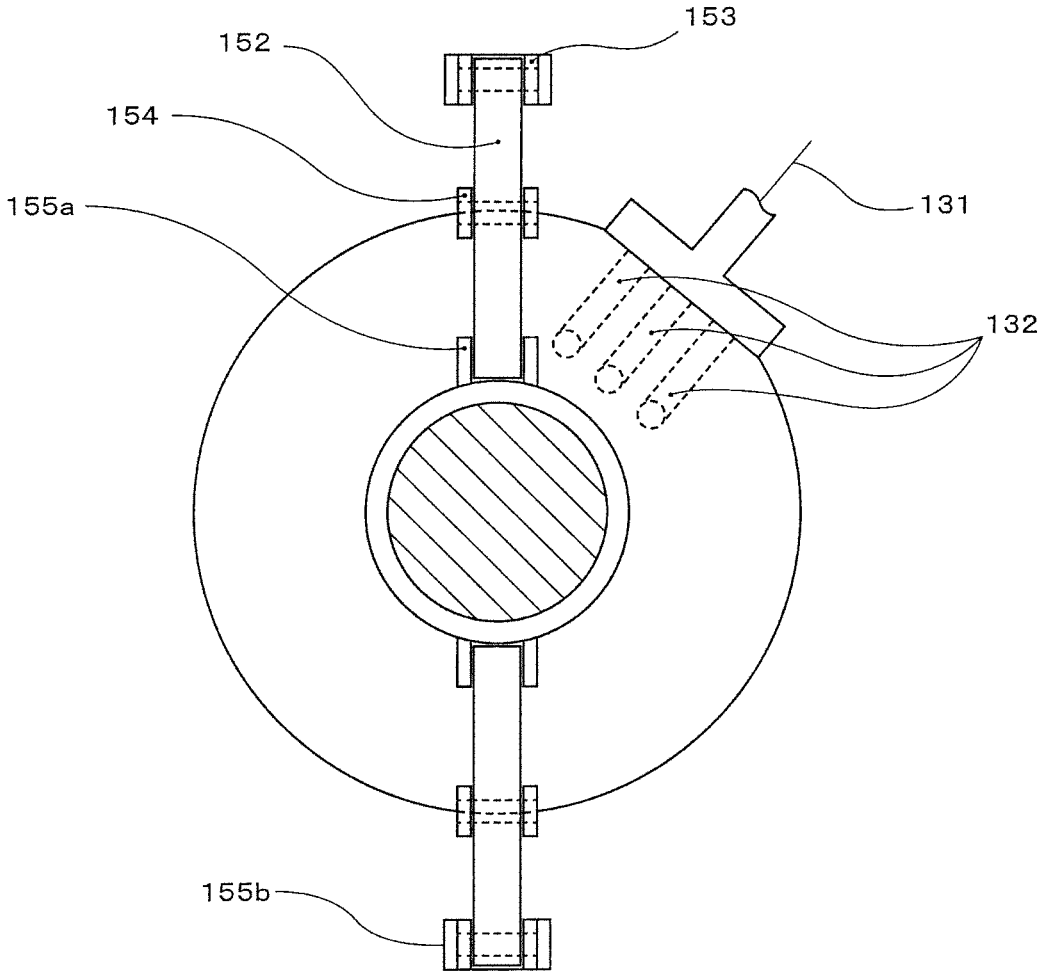
FIG. 13 is a view of the cross-section along Y-Y of FIG. 12 as seen from the arrow direction. A pipeline for removing the air in the container is shown shifted from the position of the extrusion lever.

FIG. 13 is a view of a cross-section along Y-Y of FIG. 12 as seen from the arrow direction and shows the state of degassing passages 132 and a pipeline 131.

In the case of the present configuration, the degassing passages 132, pipeline 131, etc. are set at slightly tilted positions avoiding the positions of the extrusion lever 152 etc.

Figure 14:
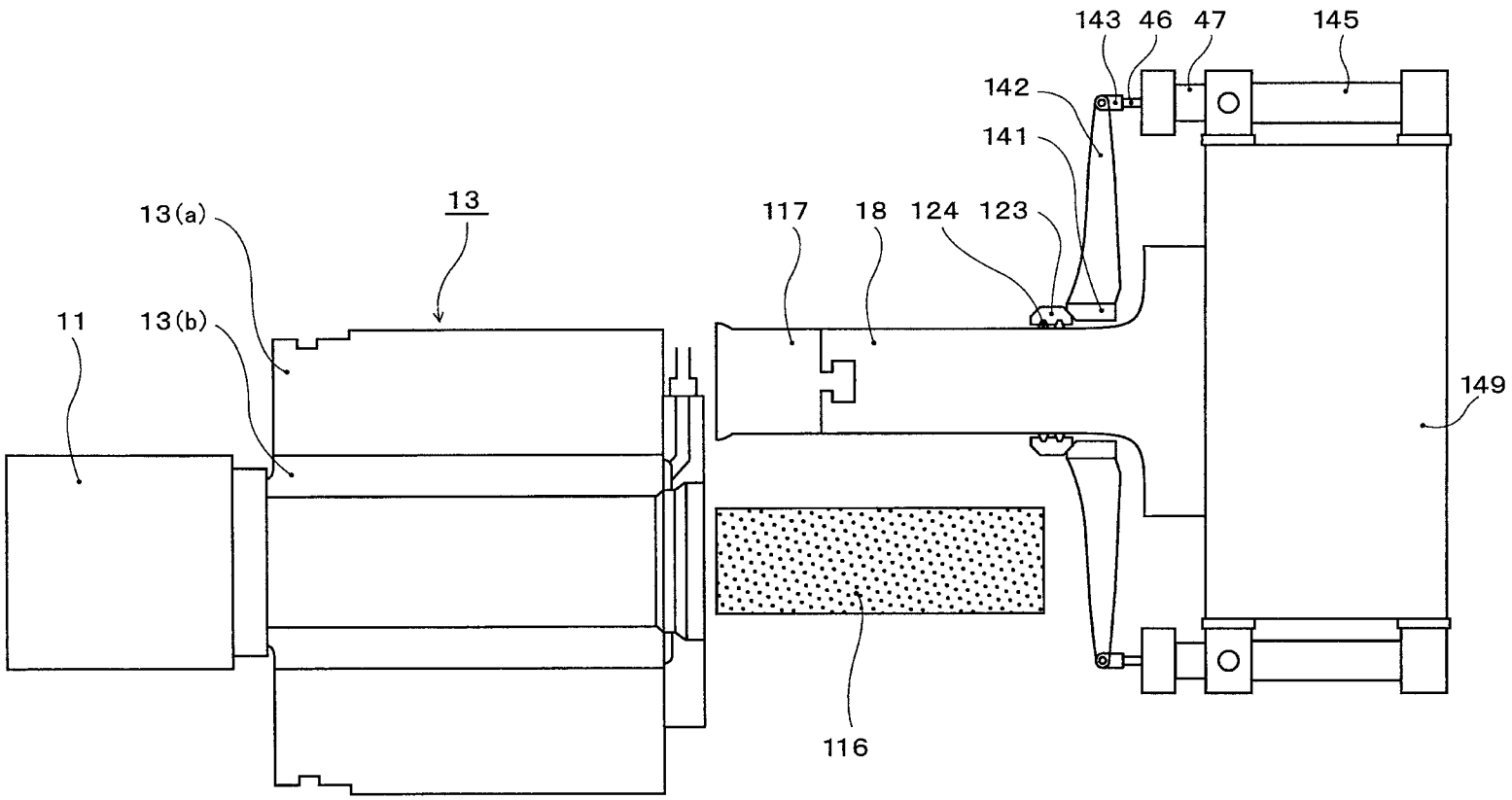
FIG. 14 is a cross-sectional view of a side view of principal parts of a rear loading (stem slide) extrusion press according to a sixth embodiment and a view right before supplying a billet to a container.

FIG. 14 is a schematic view of a rear loading extrusion press (stem slide) according to the sixth embodiment at the time of loading a billet 116. In the figure, drive cylinders 145 of the pushing frame device are fastened to a stem slide 149. In the figure, first the extrusion stem 18 and the hydraulic cylinders 145 which are fastened to the stem slide 149 stand by above the axial line of the container 13. Simultaneously, the seal member 123 stands by above in the same way at a rear position of the extrusion stem 18. First, to start, a billet 116 is loaded by a not shown billet loader above the axial line of the container 13. Next, an insertion device of the billet loader is used to insert the billet 116 into the container 13. Next, the billet loader retracts to outside the machine. After that, the stem slide 149 descends to the axial center of the container, then the pushing frames 142 advance, whereby the seal member 123 abuts against the degassing block 121 and the extrusion stem 18 advances to the upsetting position.

Figure 15:
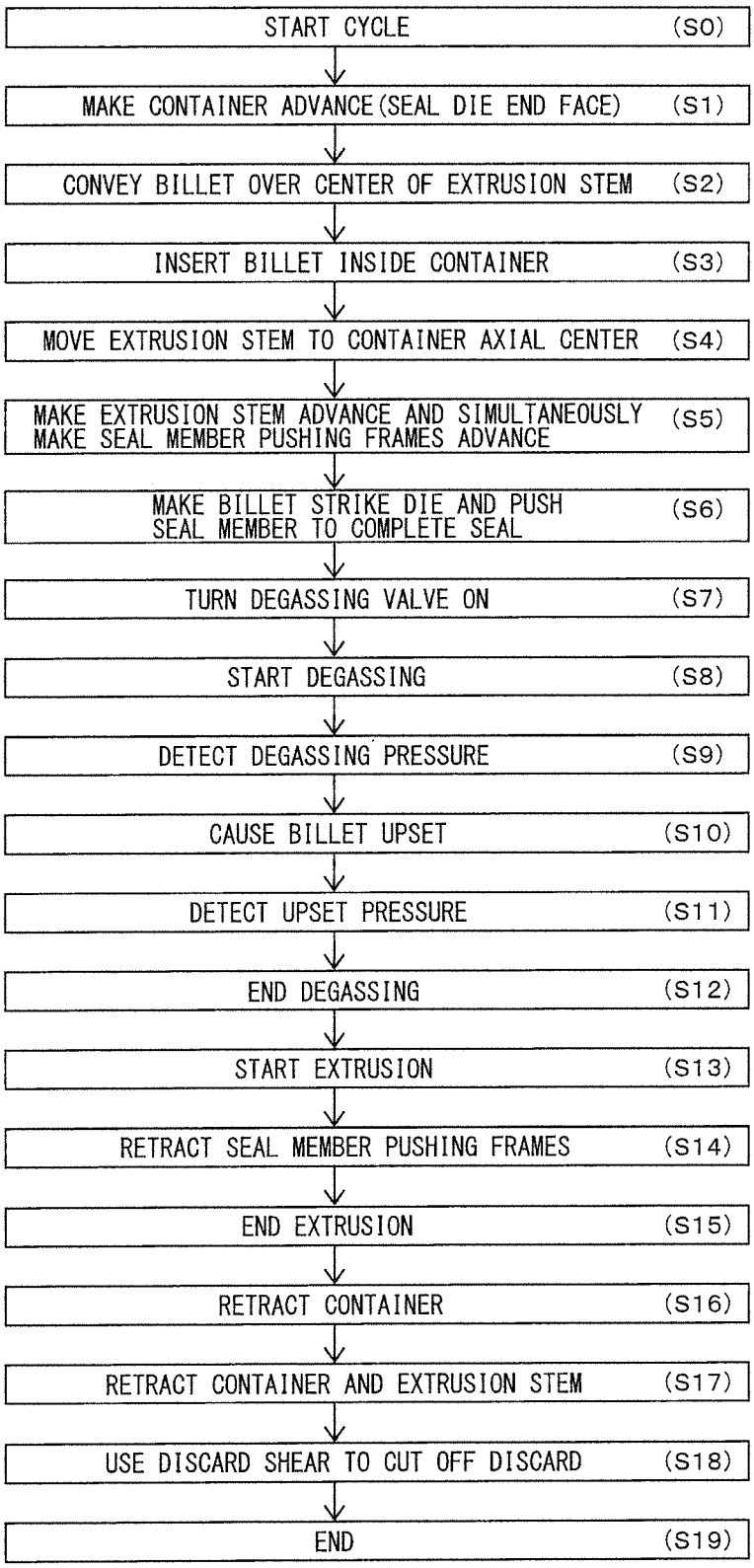
FIG. 15 is an operational flow chart of a rear loading extrusion press according to a sixth embodiment.

Next, the extrusion operation of a rear loading extrusion press according to the sixth embodiment will be explained based on the operational flow chart of FIG. 15.

In the initial state, the extrusion stem 18 stands by above the center of the extrusion press, while the container 13 is retracted in the anti-extrusion direction.

First, to start, the container 13 advances and seals the die 11 end face (S1). Next, a not shown billet loader is used to supply a billet 116 above the axis of the container 13 (S2). Next, the billet loader inserts the billet 116 into the container 13. After that, the billet loader retracts to outside the machine. Next, the extrusion stem 18 moves to the position of the center of the extrusion press (S4).

Next, the pushing frames 142 advance simultaneously with the extrusion stem 18 advancing (S5). The billet 116 strikes the die 11 and pushes the seal member 123 against the degassing block 121 to complete the seal (S6).

In this state, the air in the degassing space 15 in the container 13 starts to be removed. First, the degassing valve 128 is turned on (S7), then the air in the degassing space 15 starts to be removed (S8). When the vacuum value of the degassing space 15 reaches the target value (detected by pressure sensor 25 (S9)), the upsetting operation of the billet 116 is started (S10). When the pressure of the upsetting operation reaches the target value (S11), the degassing space 15 finishes being degassed (S12) and simultaneously extrusion is started (S13).

When extrusion is started, the seal member pushing frames retract (S14). After extrusion ends (S15), the container 13 is made to retract just slightly (S16). After that, the container 13 and the extrusion stem 18 retract (S17). Next, a not shown discard shear is used to cut off the discard (S18). Due to the above, one cycle is completed (S19) and the next cycle is proceeded to.

Figure 16:
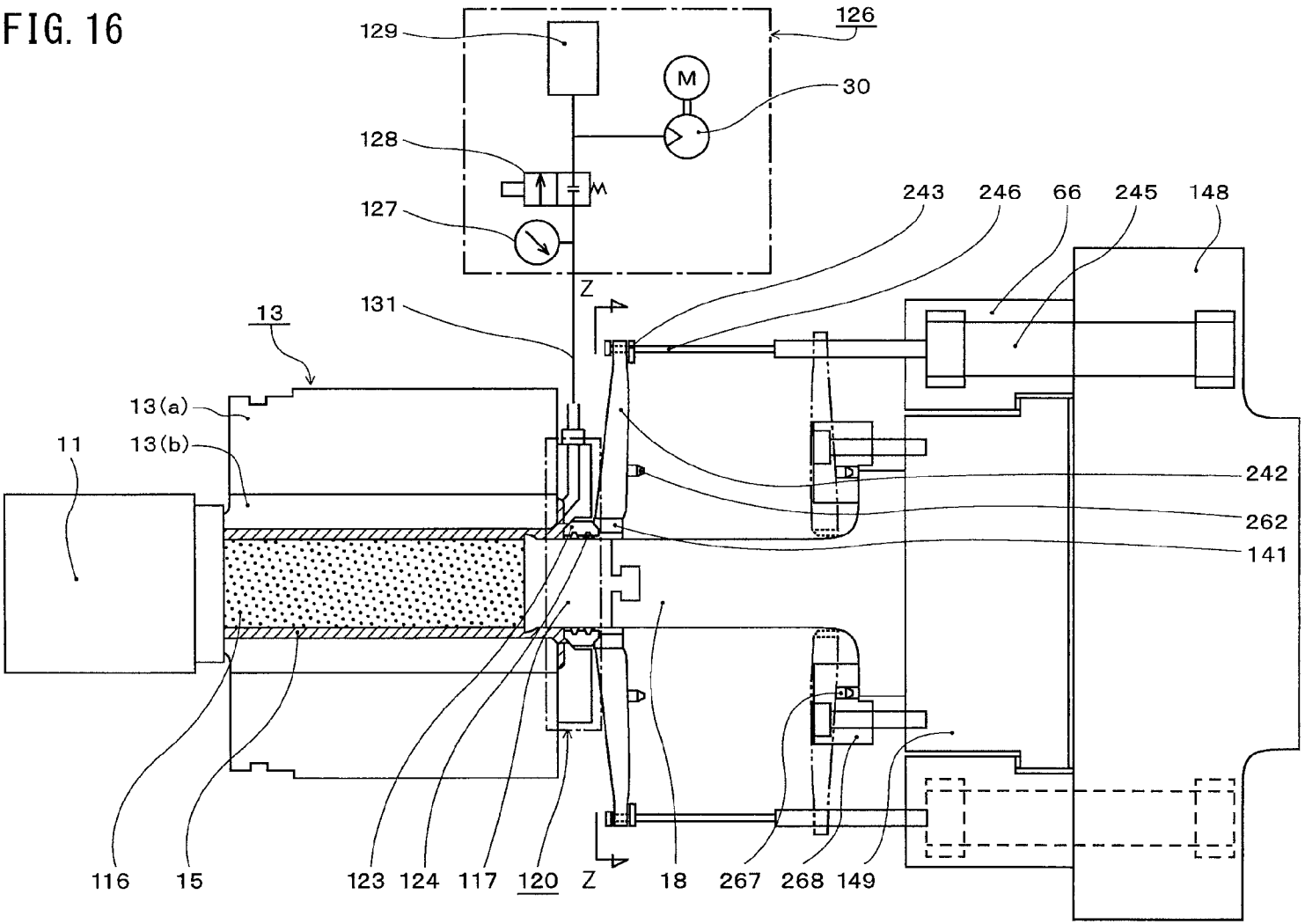
FIG. 16 is a cross-sectional view of a plan view which shows an outline of the part from the die to the main crosshead of a rear loading extrusion press according to a seventh embodiment.

FIG. 16 is a schematic view of a rear loading extrusion press according to the seventh embodiment as seen from a plan view at the time of loading a billet 116. In the case of this figure, hydraulic cylinders 245 which drive the pushing frames 242 are fastened to stem slide guides 66 and a main crosshead 148. The pushing frames 242 are not fastened with rods 243 of the drive-use hydraulic cylinders 245 and separate from the hydraulic cylinders 245 when the extrusion stem 18 rises. When the pushing frames 242 separate from the hydraulic cylinders 245, they rotates around the extrusion stem 18, so fastening pins 262 are attached to the pushing frames 242 as turn stoppers. The fastening pins 262 are inserted into fastening pin insertion holes 267 provided in the extrusion stem fastening parts 268 whereby the pushing frames 242 can move to the raised position without rotating.

Figure 17:
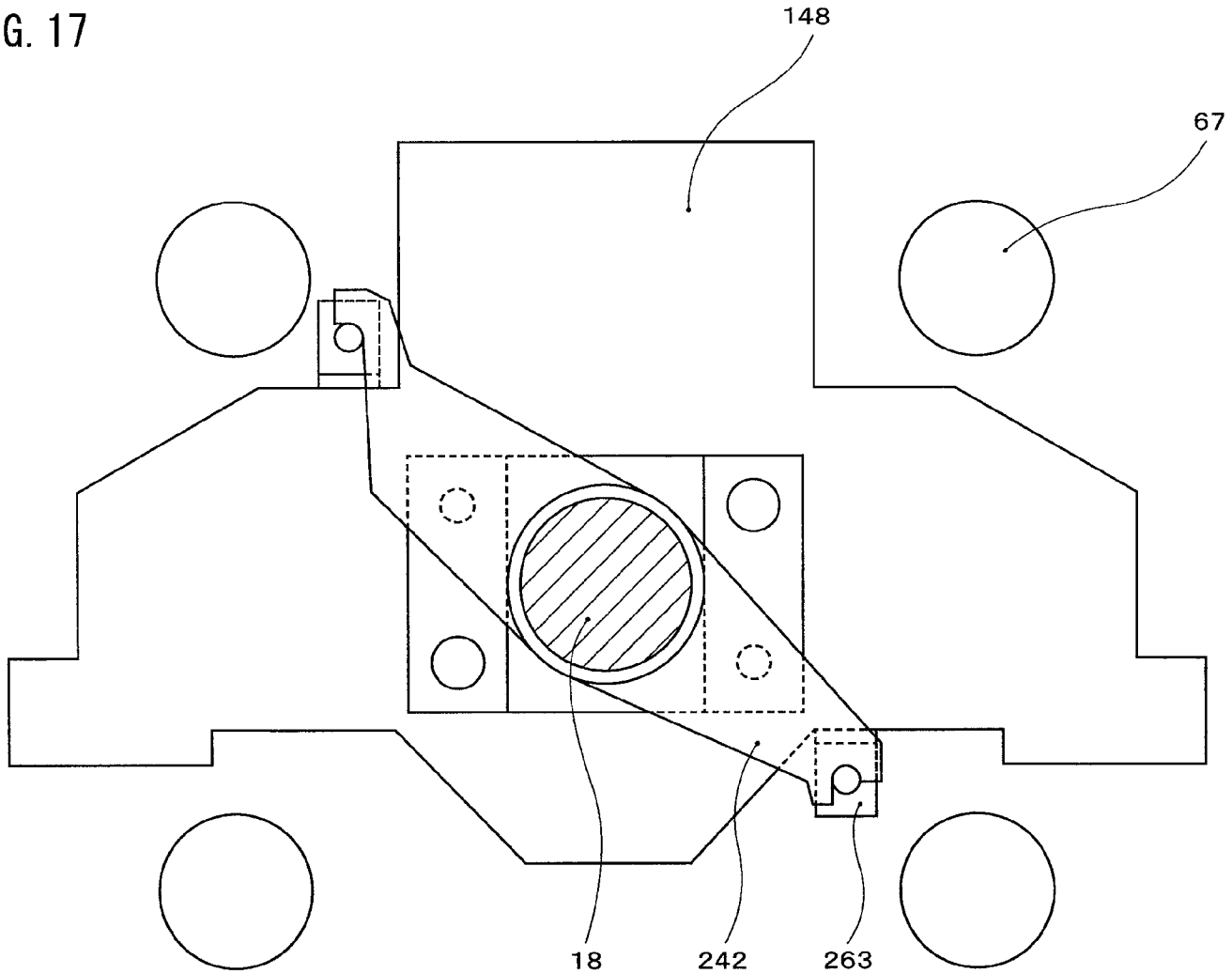
FIG. 17 is a view of the cross-section along Z-Z of FIG. 16 as seen from the arrow direction and shows the state of the pushing frames when the stem slide is at the center of the extrusion press.

FIG. 17 is a view of the cross-section along Z-Z of FIG. 16 as seen from the arrow direction and shows the state of the pushing frames 242 when the stem slide 149 is at the center of the extrusion press.

The two end faces of the pushing frames 242 abut so that the rods 243 of the hydraulic cylinders 245 are clenched, but they are not fastened to them, so when moving to the raised position, the pushing frames 61 separate from the rods 243 of the hydraulic cylinders 245.

Further, these are attached to be able to advance and retract in the longitudinal direction of the extrusion press by the hydraulic cylinders 245.

Figure 18:
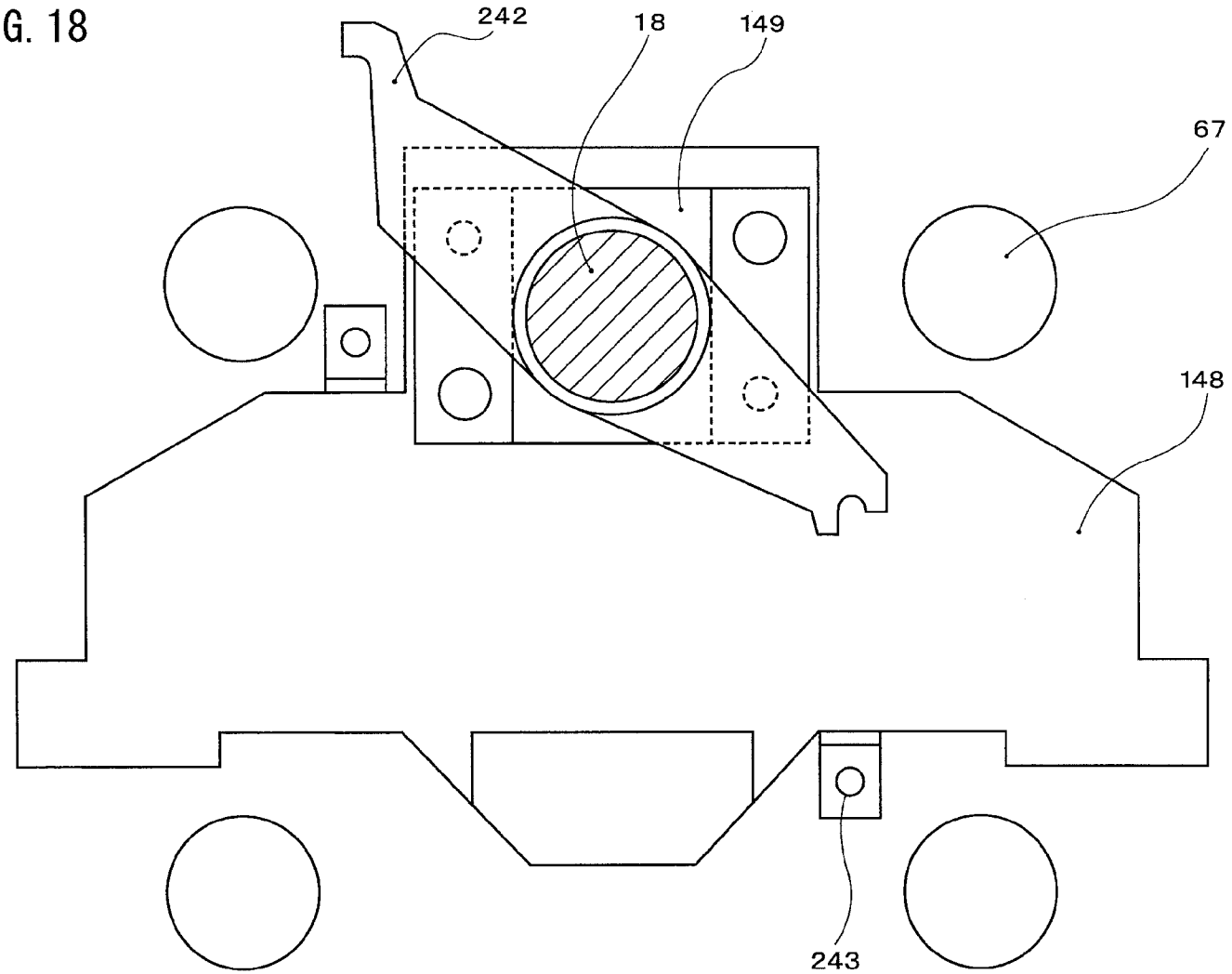
FIG. 18 is a view of the cross-section along Z-Z of FIG. 16 as seen from the arrow direction and shows the state of the pushing frames when the stem slide is at a raised position.

FIG. 18 is a view of the cross-section along Z-Z of FIG. 16 as seen from the arrow direction and shows the state of the pushing frames 242 when the stem slide 149 is at the raised position. When the pushing frames 242 are at the raised position, the fastening pins 262 of the pushing frames 242 are inserted into the fastening pin insertion holes 267 at the extrusion stem fastening parts 268, so the pushing frames 242 will not rotate.

The one-piece degassing block is made to abut against the container end face, and the space which is surrounded by the degassing block and a movable seal member which abuts against the fixed dummy block or extrusion stem is degassed by a vacuum pump etc., so it becomes possible to realize long maintenance of a high degree of vacuum free of variation inside the container.

As a result, air is no longer entrained in the extruded product, blisters and oxides no longer form, the yield is improved, simultaneously burp cycles are eliminated, the idle time becomes shorter, and the productivity is improved.

Further, the one-piece degassing block is made to abut against the container end face and the seal member is also made to contact by metal-to-metal contact, so frequent replacement of the seal member becomes unnecessary and the replacement time of the seal member can be shortened. In the past, the two-piece split degassing block has been loaded by a loading device and joined by an opening/closing device, but in the present invention, the loading device and opening/closing device of the degassing block are no longer necessary. It is possible to realize space savings and the costs are reduced and the structure simplified, so maintenance etc. become easy.

Note that, the present invention is described in detail based on specific embodiments, but a person skilled in the art can made various changes, corrections, etc. without departing from the claims and concepts of the present invention.

The invention claimed is:

1. A container degassing device of an extrusion press comprising:

a one-piece degassing block joined to an end face of a container of the extrusion press;

a first seal member in close contact with said degassing block;

a second seal member in close contact with an outer circumferential surface of a fixed dummy block or extrusion stem of said extrusion press; and a vacuum suction device that sucks out air in a degassing space formed in said container, wherein said degassing space is tightly closed by said degassing block and said first and second seal members, and said degassing block and said container end face are tightly closed by metal-to-metal contact.

2. The container degassing device according to claim 1, wherein said degassing block has at least one hole to remove air communicated with said degassing space and fluidly connected to said vacuum suction device, said first seal member is configured to tightly close said degassing block by metal-to-metal contact, and when degassing said degassing space, atmospheric pressure outside said degassing space acts on said first and second seal members so that tight closure of said degassing space is improved.

3. The container degassing device according to claim 1, wherein said first seal member and said second seal member contact each other and said second seal member receives force from said first seal member.

4. A container degassing device of an extrusion press comprising:

a one-piece degassing block joined to an end face of a container of the extrusion press;

a first seal member in close contact with said degassing block;

at least one second seal member in close contact with an outer circumferential surface of a fixed dummy block or extrusion stem of said extrusion press; and a vacuum suction device that sucks out air in a degassing space formed in said container, wherein said first seal member and said at least one second seal member can move relative to said extrusion stem, said degassing space is tightly sealed by said degassing block and said first and second seal members, and said degassing block and said container end face are tightly closed by metal-to-metal contact.

5. The container degassing device according to claim 4, further comprising pushing frames which make said first seal member move to push against said degassing block and are operated by fluid cylinders, wherein said first seal member and said at least one second seal member are in contact with each other, and said at least one second seal member receives force through said first seal member from said pushing frames.

6. The container degassing device according to claim 4, wherein said pushing frames move up and down together with the extrusion stem and are provided with turn stoppers.

7. The container degassing device according to claim 4, wherein a container-side end face of said degassing block is provided with a cut groove to remove air.

* * * * *